United States Patent [19]

Brice

[11] 4,160,493

[45] Jul. 10, 1979

[54] PLATFORM ATTACHMENT

[76] Inventor: Robert D. Brice, 537 Yandees St., Franklin, Ind. 46131

[21] Appl. No.: 866,265

[22] Filed: Jan. 3, 1978

[51] Int. Cl.[2] ..... E06C 7/16; E04G 1/30

[52] U.S. Cl. ..... 182/122; 248/235; 182/118

[58] Field of Search ..... 182/121, 122, 120, 45, 182/178, 179, 117, 118; 248/235, 210

[56] References Cited

U.S. PATENT DOCUMENTS

| | | | |
|---|---|---|---|
| 2,066,462 | 1/1937 | Fenton | 182/122 |
| 2,069,969 | 2/1937 | Nelson | 182/121 |
| 2,848,282 | 8/1958 | Weber | 182/45 |

*Primary Examiner*—Reinaldo P. Machado

*Attorney, Agent, or Firm*—Woodard, Weikart, Emhardt & Naughton

[57] ABSTRACT

A platform attachment is disclosed herein which comprises a pair of posts having cross members connecting therebetween. Extensions are secured to opposite sides of each post at the bottom end of the post to receive therebetween a ladder rung. A pair of arms is connected to each of the posts and the arms are pivotally connected thereto. Each of the pair of arms receives therebetween one of the ladder rails. A platform is mounted upon the pairs of arms and includes members which are received between each of the pairs of arms.

10 Claims, 7 Drawing Figures

PLATFORM ATTACHMENT

BACKGROUND OF THE INVENTION

1. Field of the Invention

The present invention relates to a platform attachment for providing a horizontal platform mounted upon a ladder.

2. Description of the Prior Art

A variety of work platforms for use in connection with ladders has been proposed in the prior art. Each of these platforms includes a differing structure which provides unique and advantageous features associated therewith. The present invention is directed at a platform attachment for a ladder which provides a platform which is extremely stable and readily accessible once erected, and also provides for a quick and simple means for mounting the platform.

A supporting means for ladders and scaffolds is disclosed in U.S. Pat. No. 2,680,554, issued to Dakin on June 8, 1954. In one embodiment, the Dakin device comprises a pair of interconnected arms which are pivotally attached to sleeve-like brackets which are mounted to the side rails of the ladder and rest upon a rung of the ladder. At the top end of each of this pair of arms is pivotally connected an arm which at its opposite end is pivotally mounted to a sleeve-like bracket which is mounted to a side rail of the ladder and rests upon a second, higher rung of the ladder. The ladder arms provide a horizontal surface upon which a scaffold or similar platform may be supported.

A ladder work platform is disclosed in U.S. Pat. No. 2,641,511, issued to McClure on June 9, 1953. The McClure platform includes a pair of posts which are mounted upon a ladder rung by retaining the rung within a bracket which is bolted to each post. A cross member connects the tops of the posts, and a platform is mounted upon the cross member and upon a rung of the ladder. The platform extends from the post to the ladder and beyond the ladder to a location at which additional support members are connected between the platform and a third rung of the ladder positioned above the platform. In U.S. Pat. No. 1,593,366, issued to Singer on July 20, 1926, there is disclosed a similar platform attachment which includes a pair of posts mounted upon a step of a ladder and a platform mounted upon and extending between the upper ends of the posts and a second and higher rung of the ladder. Yet another similar device is diclosed in U.S. Pat. No. 2,606,079, issued to White on Aug. 5, 1952. The White device further includes the provision of bifurcated lower ends of the posts within which bifurcations the ladder rung is received. In U.S. Pat. No. 1,645,879, issued to Skeels on Oct. 18, 1927, there is disclosed a platform support which includes a platform resting at one end upon a ladder rung and including a bracket which secures and supports the opposite end of the platform upon a second and higher rung of the ladder.

An adjustable ladder attachment is disclosed in U.S. Pat. No. 2,459,437, issued to Kreissler et al. on Jan. 18, 1949. In the Kreissler attachment, a platform is provided which includes a lip which engages a side of a ladder rung when the platform is rested upon the rung. A first pair of brackets are located on the underside of the platform near the platform lip and a first pair of arms are pivotally attached to the respective brackets. The first pair of arms are positioned to extend along the ladder and rest upon a lower ladder rung, with a rod interconnecting the lower ends of the first pair of arms. A second pair of brackets are located on the underside of the platform and spaced apart from the first pair of brackets. A second pair of arms are pivotally attached to the second pair of brackets and include a plurality of notches at their lower ends which are oriented to receive the interconnecting rod therein. By appropriate selection of the notches to receive the interconnecting rod, the angle of the platform may be varied to correspond to a varying angle of incline for the ladder.

SUMMARY OF THE INVENTION

In a preferred embodiment of the present invention, the platform attachment comprises first and second posts and first and second attachment means for attaching the respective posts to a first ladder rung with the posts being supported upon the rung. A plurality of cross members are connected to and extend between the posts. A first pair of arms is pivotally attached on opposite sides to the first post, and a second pair of arms is pivotally attached on opposite sides to the second post. Means are provided for attaching the first pair of arms on opposite sides of a first ladder rail and the second pair of arms on opposite sides of the second ladder rail, the interior arm of each pair resting upon and being supported by a ladder rung. The platform attachment further includes a platform and means for removably mounting the platform upon the first and second pairs of arms between the posts and the ladder.

It is an object of the present invention to provide a platform attachment which is readily and inexpensively constructed, and which is easily and quickly mounted upon a ladder.

Another object of the present invention is to provide a platform attachment which when mounted to a ladder provides a secure and stable support platform.

It is a further object of the present invention to provide a platform attachment which, when erected upon a ladder, provides a platform which is readily accessible, and more specifically which includes cross members which may be used in the same manner as the regular ladder rungs to facilitate climbing onto or off of the platform.

Another object of the present invention is to provide a platform attachment which securely and strongly affixes to a ladder, and which by its construction and manner of attachment is capable of supporting a substantial amount of weight.

Further objects and advantages of the present invention will become apparent from the Description of the Preferred Embodiment which follows.

DESCRIPTION OF THE PREFERRED EMBODIMENT

Figure 1:
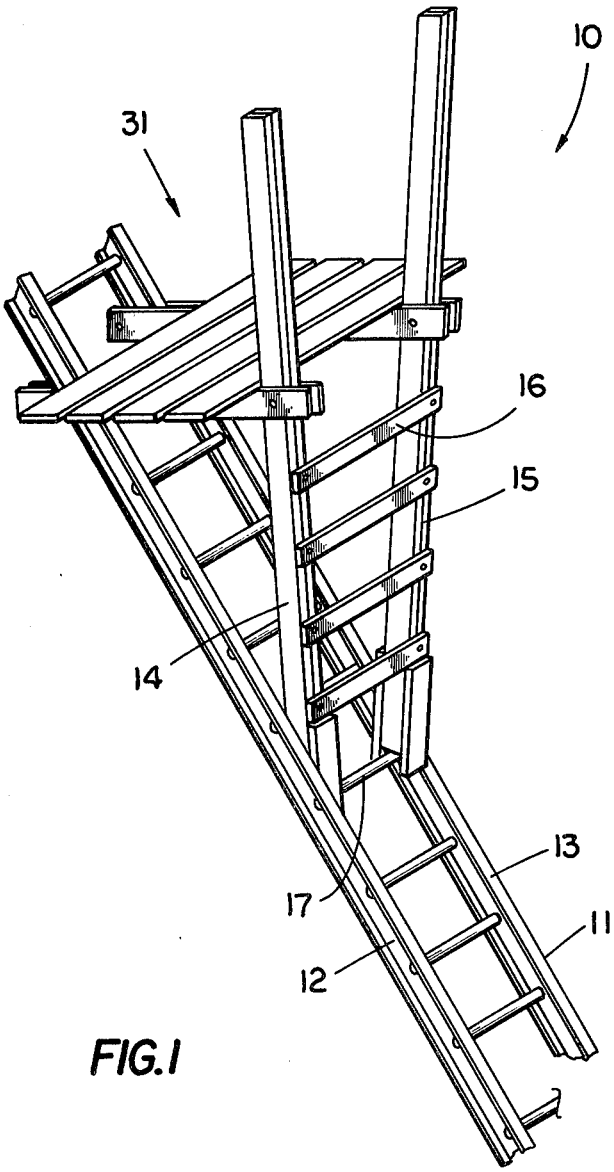
FIG. 1 is a perspective view of the platform attachment of the present invention shown mounted upon a ladder.

As previously noted, a number of varying platform constructions have been proposed in the prior art. The platform attachment of the present invention provides a simple, inexpensive and sturdy construction which is readily mounted upon a ladder and which provides ready access to and from the platform. Referring now to the drawings, there is shown a platform attachment 10 constructed in accordance with the present invention. Platform attachment 10 is mountable upon a ladder 11 having side rails 12 and 13 and several rungs connecting therebetween.

Platform attachment 10 comprises a first post 14 and a second post 15. A plurality of cross members 16 are connected to and extend between the first post 14 and second post 15. The cross members preferably provide for the upper ends of the posts to be spaced apart farther than the lower ends of the posts to give a wider support base than the ladder upon which the posts are mounted.

Means are provided for attaching the lower ends of the posts 14 and 15 to a rung 17 of the ladder 11. In the preferred embodiment, the attaching means includes extensions 18 and 19 (FIG. 5) which are mounted adjacent to and extend beyond the lower end of first post 14, and extensions 20 and 21 (FIG. 5) which are mounted adjacent to and extend beyond the lower end of second post 15. Rung 17 of ladder 11 is received between extensions 18 and 19 and between extensions 20 and 21 with the lower ends of the posts 14 and 15 being positioned upon and supported by the rung 17.

Figure 2:
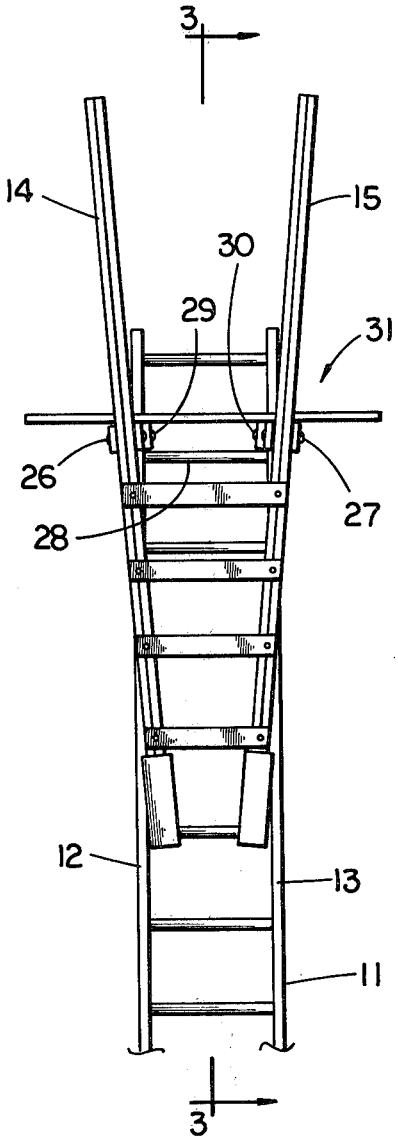
FIG. 2 is a front, elevational view of the platform attachment shown in FIG. 1.
Figure 3:
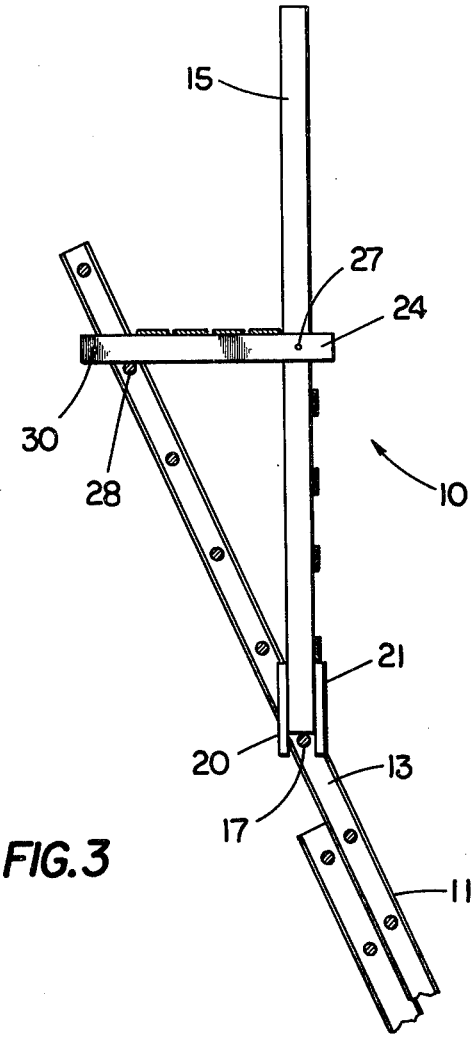
FIG. 3 is a side, cross-sectional view of the platform attachment shown mounted upon a ladder, taken along line 3—3 in FIG. 2 and viewing in the direction of the arrows.
Figure 4:
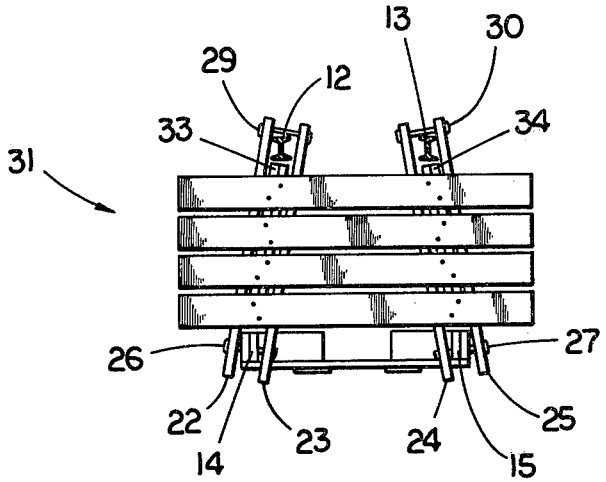
FIG. 4 is a partial, top view of the platform attachment and ladder as shown in FIG. 1.

A first pair of arms 22 and 23 are pivotally attached by a bolt 26 (FIG. 4) to first post 14 at a position intermediate the ends of post 14. Similarly, a second pair of arms 24 and 25 are pivotally attached by a bolt 27 (FIG. 2) to second post 15 at a position intermediate the ends of post 15. When the platform attachment 10 is mounted upon a ladder, as exemplified in FIG. 1, the first and second pairs of arms extend from the respective posts to corresponding side rails of the ladder. The first pair of arms 22 and 23 are attached on opposite sides of first post 14 and extend to opposite sides of first side rail 12 of ladder 11. The second pair of arms 24 and 25 are secured to opposite sides of first post 15 and extend to opposite sides of second side rail 13 of ladder 11. As shown in FIG. 4, the arms 23 and 24 extend interiorly of side rails 12 and 13, and are thereby positioned to rest upon a rung 28 (FIG. 2) of ladder 11. Arms 22 and 25 are secured to arms 23 and 24, respectively, by bolts 29 and 30 (FIG. 4). The bolts 29 and 30 are positioned on the sides of side rails 12 and 13 opposite the posts 14 and 15 to secure the posts to the ladder through the respective arms.

A platform 31 is removably mounted upon the first and second pair of arms between the posts and the ladder. Platform 31 may have a variety of constructions, with a simple and preferred construction being that shown in FIG. 7 as comprising a plurality of board-like members 32 attached to a first member 33 and a second member 34. With this preferred construction, the platform 31 is mounted upon the arms 22–25 with the first member 33 being received between the first pair of arms 22 and 23, and the second member 34 being received between the second pair of arms 24 and 25. In this manner, the platform is secured from horizontal movement due to the confinement of members 33 and 34 within the spaces defined by the arms, the posts and the side rails of the ladder.

Figure 5:
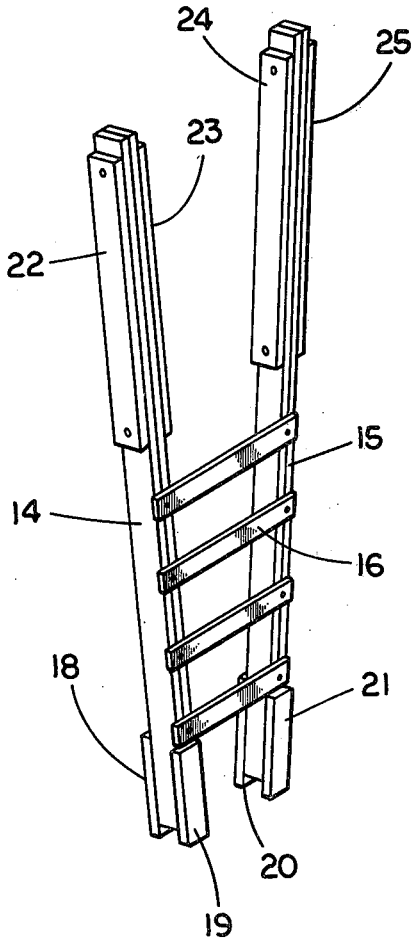
FIG. 5 is a perspective view of the portion of the platform attachment of the present invention which directly mounts to a ladder and supports the platform, the supporting portion being shown with the arms positioned adjacent the posts as would be the position prior to mounting of the platform attachment.
Figure 7:
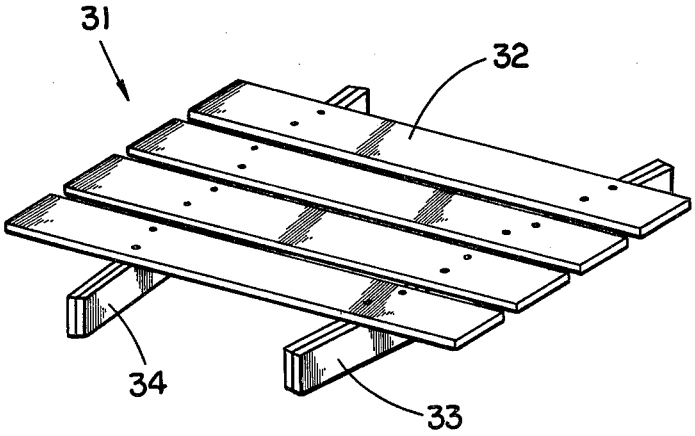
FIG. 7 is an enlarged, perspective view of a platform useful in conjunction with the present invention.
Figure 6:
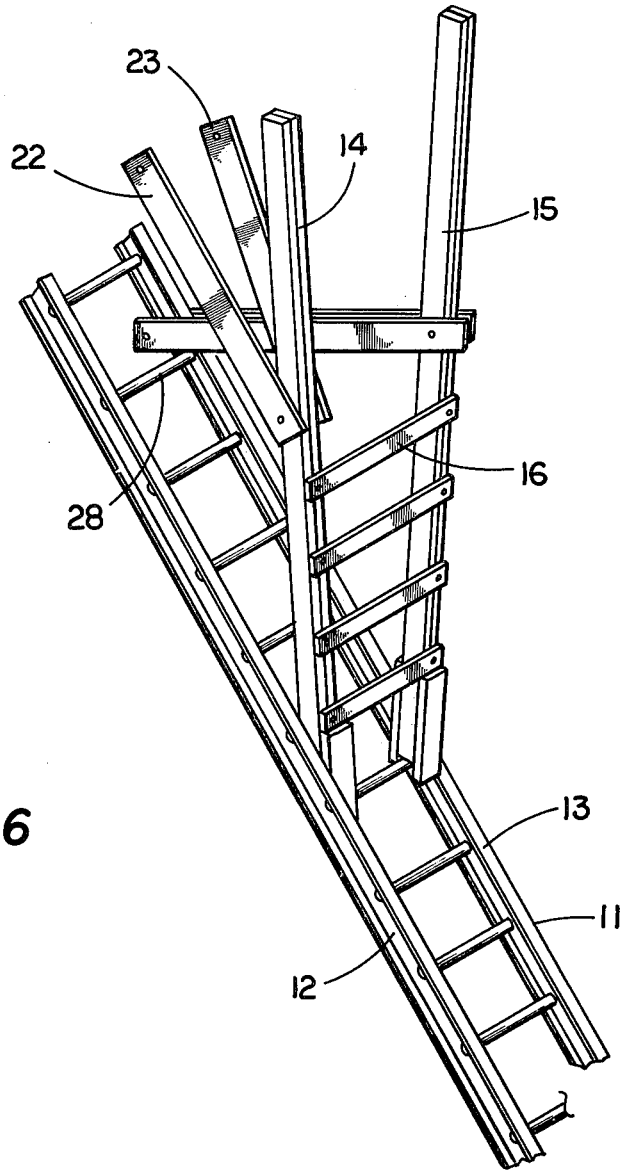
FIG. 6 is a perspective view of the support portions shown in FIG. 5 and partially mounted upon a ladder, the first pair of arms being shown partially pivoted in the direction of the ladder.

Referring in particular to FIGS. 5 and 7, it is shown that the platform attachment of the present invention is easily and quickly mounted upon a ladder which has been positioned adjacent a building or other structure. Initially, the supporting arms and posts are carried to the desired position in the configuration shown in FIG. 5 with the arms pivoted adjacent the posts. If desired, means could be provided for firmly holding the arms in the position shown during transportation of this portion of the unit. Such means could comprise for example the provision of holes in the upper portions of the arms which would receive the bolts 29 and 30 and temporarily secure the arms in the indicated position. When the supporting portion has been raised to the desired location, the bottom ends of the posts 14 and 15 are rested upon the desired rung of the ladder and the arms are then pivoted downwardly against the appropriate rung upon which the interior arms 23 and 24 will rest. When the arms have been secured by the bolts 29 and 30, as previously described, the platform 31 may be positioned upon the arms. It is preferable to mount the platform attachment of the present invention by first transporting the platform to a position above the desired location of the attachment. The supporting portions are then carried to the desired location and the person mounting the unit positions himself between the posts 14 and 15 and the ladder during the installation. In this manner, the installer is positioned to readily pivot the arms into position against the ladder rung and to secure the bolts to the arms.

It will be appreciated that in the preferred embodiment above described, the platform and specifically the members 33 and 34 are utilized to maintain the spacing of the upper portions of the posts from the ladder. In an alternative embodiment, means could specifically be provided in addition to the platform which would prevent the posts from moving towards the ladder prior to the platform being placed in position. Thus, provision could be made for a second pair of bolts (not shown) to extend between the respective pairs of arms immediately adjacent the side of the rails of the ladder opposite the side against which the bolts 29 and 30 are positioned. In this manner, the bolts being positioned upon opposite sides of the rails would prevent the arms from moving in either direction with respect to the rails. With means such as this being provided, the platform can readily be put into position simply by climbing the cross-members 16. The provision of the described means, such as the additional pair of bolts, is not considered to be necessary since it is generally preferred that the person installing the platform attachment be positioned between the posts and the ladder since it is in this area that the bolts 29 and 30 must be attached. Thus, since the person installing the unit would preferably be in this position, the inclusion of the additional means is not considered to be necessary.

What is claimed is:

1. A platform attachment, for a ladder having side rails and several rungs extending therebetween, which comprises:

first and second posts, each post having a first end and a second end, first attachment means for attaching said first post to a first ladder rung with the first end of said first post supported upon the first ladder rung;

second attachment means for attaching said second post to the first ladder rung with the first end of said second post supported upon the first ladder rung;

a cross member connected to and extending between said first and second posts;

a first pair of arms, each of said first pair of arms having a first end and a second end, the first ends of said first pair of arms being pivotally attached to said first post on opposite sides of said first post;

a second pair of arms, each of said second pair of arms having a first end and a second end, the first ends of said second pair of arms being pivotally attached to said second post on opposite sides of said second post;

third attachment means for attaching the second ends of said first pair of arms on opposite sides of a first ladder rail with one of said first pair of arms supported upon a second ladder rung;

fourth attachment means for attaching the second ends of said second pair of arms on opposite sides of a second ladder rail with one of said second pair of arms supported upon the second ladder rung;

a platform; and mounting means for removably mounting said platform upon said first and second pairs of arms between said posts and the ladder.

2. A platform attachment, for a ladder having side rails and several rungs extending therebetween, which comprises:

first and second posts, each post having a first end and a second end, first attachment means for attaching said first post to a first ladder rung with the first end of said first post supported upon the first ladder rung;

second attachment means for attaching said second post to the first ladder rung with the first end of said second post supported upon the first ladder rung;

a cross member connected to and extending between said first and second posts;

a first pair of arms, each of said first pair of arms having a first end and a second end, the first ends of said first pair of arms being pivotally attached to said first post on opposite sides of said first post;

a second pair of arms, each of said second pair of arms having a first end and a second end, the first ends of said second pair of arms being pivotally attached to said second post on opposite sides of said second post;

third attachment means for attaching the second ends of said first pair of arms on opposite sides of a first ladder rail with one of said first pair of arms supported upon a second ladder rung;

a platform; and mounting means for removably mounting said platform upon said first and second pairs of arms between said posts and the ladder said platform including an underside, said platform including a first member and a second member secured on the underside, the first member being received received between said first pair of arms and the second member being received between said second pair of arms.

3. The apparatus of claim 1 in which the first ends of said first pair of arms and the first ends of said second pair of arms are attached to said posts intermediate said cross member and the second ends of said posts.

4. The apparatus of claim 2 in which the first ends of said first pair of arms and the first ends of said second pair of arms are attached to said posts intermediate said cross member and the second ends of said posts.

5. The apparatus of claim 1 in which said first attachment means includes first and second extensions secured adjacent and extending beyond the first end of said first post and receiving the first ladder rung therebetween, and in which said second attachment means includes first and second extensions secured adjacent and extending beyond the first end of said second post and receiving the first ladder rung therebetween.

6. The apparatus of claim 4 in which said first attachment means includes first and second extensions secured adjacent and extending beyond the first end of said first post and receiving the first ladder rung therebetween, and in which said second attachment means includes first and second extensions secured adjacent and extending beyond the first end of said second post and receiving the first ladder rung therebetween.

7. The apparatus of claim 6 in which said third attachment means comprises a first connecting member connecting the second ends of said first pair of arms, the first ladder rail being between the first connecting member and said first post, and in which said fourth attachment means comprises a second connecting member connecting the second ends of said second pair of arms, the second ladder rail being between the second connecting member and said second post.

8. The apparatus of claim 1 and which includes a plurality of cross members, each cross member being connected to and extending between said first and second posts.

9. The apparatus of claim 7 and which includes a plurality of cross members, each cross member being connected to and extending between said first and second posts.

10. The apparatus of claim 9 in which the distance between said first and second posts increases from the first ends of said posts to the second ends of said posts.

* * * * *